US011511543B2

(12) United States Patent
Marubayashi et al.

(10) Patent No.: US 11,511,543 B2
(45) Date of Patent: Nov. 29, 2022

(54) INK JET HEAD MAINTENANCE APPARATUS AND INK JET RECORDING APPARATUS

(71) Applicant: KONICA MINOLTA, INC., Tokyo (JP)

(72) Inventors: Jun Marubayashi, Kodaira (JP); Taishi Shimizu, Sagamihara (JP)

(73) Assignee: KONICA MINOLTA, INC., Tokyo (JP)

( * ) Notice: Subject to any disclaimer, the term of this patent is extended or adjusted under 35 U.S.C. 154(b) by 82 days.

(21) Appl. No.: 16/958,927

(22) PCT Filed: Dec. 28, 2017

(86) PCT No.: PCT/JP2017/047166
§ 371 (c)(1),
(2) Date: Jun. 29, 2020

(87) PCT Pub. No.: WO2019/130531
PCT Pub. Date: Jul. 4, 2019

(65) Prior Publication Data

US 2020/0338894 A1 Oct. 29, 2020

(51) Int. Cl.
*B41J 2/165* (2006.01)

(52) U.S. Cl.
CPC ..... *B41J 2/16532* (2013.01); *B41J 2/16508* (2013.01); *B41J 2/16511* (2013.01);
(Continued)

(58) Field of Classification Search
CPC ..... B41J 2/16532; B41J 2/16508; B41J 2/16511; B41J 2/16523; B41J 2/16544; B41J 2/16547
See application file for complete search history.

(56) References Cited

U.S. PATENT DOCUMENTS 7,497,548 B2 * 3/2009 Yamazaki ..... B41J 2/16508 347/29
2007/0222815 A1 9/2007 Kusakari

FOREIGN PATENT DOCUMENTS

AT 0580437 A2 * 1/1994 ..... B41J 2/165
CN 1774344 A 5/2006
(Continued)

OTHER PUBLICATIONS

International Search Report for International Application PCT/JP2017/047166; dated Apr. 3, 2018.
(Continued)

*Primary Examiner* — Geoffrey S Mruk
(74) *Attorney, Agent, or Firm* — Cantor Colburn LLP

(57) ABSTRACT

An ink jet head maintenance apparatus includes a suction member which includes a suction hole to suction ink and in which air in the suction hole is suctioned from one opening of the suction hole by a suction operation unit. The suction member includes a height adjustment surface which is adjacent to an opening surface in which the other opening of the suction hole is provided and in which an inner angle formed with the opening surface is an obtuse angle. Each position of the opening surface is able to move in a first direction including a normal direction of the opening surface in a predetermined initial state in response to external force applied to the height adjustment surface.

18 Claims, 9 Drawing Sheets

(52) U.S. Cl.
CPC ..... *B41J 2/16523* (2013.01); *B41J 2/16544* (2013.01); *B41J 2/16547* (2013.01)

(56) References Cited

FOREIGN PATENT DOCUMENTS

| | | | |
|---|---|---|---|
| JP | 2006142507 | A | 6/2006 |
| JP | 2007168293 | A | 7/2007 |
| JP | 2007253408 | A | 10/2007 |
| JP | 2010221663 | A | 10/2010 |
| JP | 2011183768 | A | 9/2011 |
| JP | 2011212885 | A | 10/2011 |
| JP | 2015134492 | A | 7/2015 |

OTHER PUBLICATIONS

CNIPA Second Office Action for corresponding CN Application No. 201780097983.7; dated Nov. 2, 2021.
CNIPA First Office Action for corresponding CN Application No. 201780097983.7; dated Feb. 3, 2021.
EPO Extended European Search Report for corresponding EP application 17936492.2: dated Dec. 4, 2020.
JPO Office Action/Search Report corresponding to JP Application No. 2019-561517; dated Apr. 6, 2021.
International Preliminary Report on Patentability with Written Opinion of the International Searching Authority for the International Patent Application No. PCT/JP2017/047166, dated Jun. 30, 2020.

* cited by examiner

| SWEEPING SPEED | MAINTENANCE RESULT |
|---|---|
| 10mm/sec | ○ |
| 20mm/sec | ○ |
| 30mm/sec | ○ |
| 40mm/sec | ○ |
| 50mm/sec | ○ |
| 60mm/sec | ○ |
| 70mm/sec | △ |
| 80mm/sec | △ |
| 90mm/sec | △ |
| 100mm/sec | × |

INK JET HEAD MAINTENANCE APPARATUS AND INK JET RECORDING APPARATUS

CROSS REFERENCE TO RELATED APPLICATIONS

This is the U.S. national stage of application No. PCT/JP2017/047166, filed on Dec. 28, 2017. Priority under 35 U.S.C. § 119(a) and 35 U.S.C. § 365(b) is claimed, of which is incorporated herein by reference.

TECHNICAL FIELD

The present invention relates to an ink jet head maintenance apparatus and an ink jet recording apparatus.

BACKGROUND ART

There are ink jet recording apparatuses in which ink is discharged from a nozzle and the ink is landed on a medium to form an image. In the ink jet recording apparatus, the ink may be attached and solidified to an ink discharge surface, including inside a nozzle opening, and this may have a bad effect on discharge of ink. On the other hand, there is also a maintenance apparatus in which normal ink discharge operation is maintained by wiping an ink discharge surface, scraping off the solid ink, or suctioning the ink of the ink discharge surface (For example, patent document 1).

CITATION LIST

Patent Literature

Patent Document 1: JP 2006-142507 A

SUMMARY

Technical Problem

However, according to the conventional maintenance apparatus, it is necessary to control two dimensional or three dimensional operation which is relative with relation to the ink discharge surface. Therefore, there are problems such as the operation mechanism and the control of such mechanism becoming complicated, and the cost and burden of adjustment increasing.

The purpose of the present invention is to provide an ink jet head maintenance apparatus and an ink jet recording apparatus in which maintenance of the ink discharge surface can be performed suitably with an easier configuration.

Solution to Problem

According to aspect 1 of the present invention, an ink jet head maintenance apparatus includes:

a suction member which includes a suction hole to suction ink and in which air in the suction hole is suctioned from one opening of the suction hole by a suction operation unit, wherein, the suction member includes a height adjustment surface which is adjacent to an opening surface in which the other opening of the suction hole is provided and in which an inner angle formed with the opening surface is an obtuse angle, and each position of the opening surface is able to move in a first direction including a normal direction of the opening surface in a predetermined initial state in response to external force applied to the height adjustment surface.

According to aspect 2, the ink jet head maintenance apparatus according to aspect 1, wherein, the height adjustment surface is provided in a position which comes into contact with a head unit when the maintenance apparatus is attached to an ink jet recording apparatus provided with a head unit including an ink jet head which is to be a target of suction of ink and when the suction member moves relatively in a predetermined second direction intersecting with the normal direction and the first direction in a relative motion with relation to the ink jet head from a predetermined standby position, and the suction member can move in the first direction up to a position where the height adjustment surface does not come into contact with the head unit.

According to aspect 3, the ink jet head maintenance apparatus according to aspect 1 or 2, further comprising a supporting unit which supports the suction member, wherein, the supporting unit includes a spring shaped member in which one end is connected to the suction member and which extends along the first direction, and the spring shaped member expands and contracts in response to the external force in the first direction.

According to aspect 4, the ink jet head maintenance apparatus according to any one of aspects 1 to 3, wherein the suction member includes an elastic member and the suction member expands and contracts in response to the external force in the first direction.

According to aspect 5, the ink jet head maintenance apparatus according to any one of aspects 1 to 4, wherein the height adjustment surface is a curved surface shape.

According to aspect 6, an ink jet head maintenance apparatus includes:

a suction member which includes a suction hole to suction ink and in which air in the suction hole is suctioned from one opening of the suction hole by the suction operation unit, wherein, the suction member includes an elastic member, when the maintenance apparatus is attached to an ink jet recording apparatus provided with a head unit including an ink jet head which is to be a target of suction of ink, the suction member is moved relatively with relation to the ink jet head in a predetermined second direction intersecting with a normal direction of an opening surface which is in the predetermined initial state, wherein the opening surface is provided with the other opening of the suction hole, and in response to external strength applied to the opening surface, each position of the opening surface deforms to be able to move in a first direction which intersects with the second direction and which includes the normal direction.

According to aspect 7, the ink jet head maintenance apparatus according to aspect 6, wherein, the opening surface is provided in a position which comes into contact with the head unit when the maintenance apparatus is attached to the ink jet recording apparatus and when the suction member is moved relatively with relation to the ink jet head in the second direction from a predetermined standby position, and the suction member is able to move in the first direction up to a position where the opening surface does not come into contact with the head unit.

According to aspect 8, the ink jet head maintenance apparatus according to aspect 7, wherein, the normal direction of the opening surface is provided tilted with relation to a normal direction of an ink discharge surface in which a nozzle opening of the ink jet head is provided.

According to aspect 9, the ink jet head maintenance apparatus according to any one of aspects 6 to 8, wherein the deforming includes deforming by bending along the second direction.

According to aspect 10, the ink jet head maintenance apparatus according to any one of aspects 1 to 9, further comprising the suction operation unit.

According to aspect 11, the ink jet head maintenance apparatus according to any one of aspects 1 to 10, further comprising a movement operation unit which moves the suction member in the second direction.

According to aspect 12, the ink jet head maintenance apparatus according to any one of aspects 1 to 11, wherein a width of the other opening in a third direction orthogonal to the second direction in the opening surface is wider than a width in the third direction of an ink discharge surface in an ink jet head determined in advance as a target of suction of ink.

According to aspect 13, an ink jet recording apparatus includes:

an ink jet head maintenance apparatus according to any one of aspects 1 to 12, the suction operation unit, and an ink jet head provided with a nozzle which discharges ink, wherein the maintenance apparatus is positioned to be able to suction ink on an ink discharge surface by moving relatively in the second direction with relation to the ink jet head from a predetermined standby position and by moving in the first direction from a predetermined initial state to position the opening surface to face the ink discharge surface in which a nozzle opening of the ink jet head is provided.

According to aspect 14, the ink jet recording apparatus according to aspect 13, wherein the second direction is a direction parallel to the ink discharge surface.

According to aspect 15, the ink jet recording apparatus according to aspect 14, wherein the second direction is an arrangement width direction along a long side of a nozzle arrangement range in the ink discharge surface.

According to aspect 16, the ink jet recording apparatus according to any one of aspects 13 to 15, wherein after moving in the first direction of the opening surface, the suction member moves relatively in the second direction in a state biased in a direction of the ink discharge surface.

According to aspect 17, the ink jet recording apparatus according to any one of aspects 13 to 16, wherein the ink discharge surface is formed in a concave shape in which one portion including the nozzle opening is depressed with relation to the other surrounding portions.

According to aspect 18, the ink jet recording apparatus according to any one of aspects 13 to 17, further comprising a stage which fixes and holds the ink jet head, wherein the suction member comes into contact with the stage by moving relatively with relation to the ink jet head in the second direction from a predetermined standby position and the opening surface moves in the first direction in response to external force applied to a contacting portion.

According to aspect 19, the ink jet recording apparatus according to aspect 18, wherein, in a state in which the suction member faces the ink discharge surface, the ink jet head is fixed and held by the stage in a position where the suction member comes into contact with the stage and the suction member does not come into contact with the ink jet head itself According to aspect 20, an ink jet recording apparatus includes:

an ink jet head maintenance apparatus including, a suction member including a suction hole to suction ink and a suction operation unit which suctions air in the suction hole from one opening of the suction hole, wherein, each position of an opening surface in which the other opening of the suction hole is provided is able to move in a first direction including a normal direction of the opening surface in a predetermined initial state in response to external force added to the suction member; and a head unit including, an ink jet head provided with a nozzle which discharges ink, and a stage which fixes and holds the ink jet head, wherein, the maintenance apparatus is positioned so as to be able to suction ink on the ink discharge surface by moving relatively with relation to the ink jet head in a predetermined second direction intersecting with the normal direction and the first direction from a predetermined standby position of the suction member and by moving in the first direction from the initial state in response to external force applied by contact with the stage of the suction member to position the opening surface to face an ink discharge surface provided with a nozzle opening of the ink jet head, and the stage includes a shape in which a surface which first comes into contact with the suction member in response to relative movement in the second direction forms an acute angle with the opening surface.

Advantageous Effects of Invention

According to the present invention, there is the advantageous effect that the maintenance of the ink discharge surface can be performed suitably with an easier configuration.

DESCRIPTION OF EMBODIMENTS

Embodiments of the present invention are described with reference to the drawings.

First Embodiment

Figure 1:
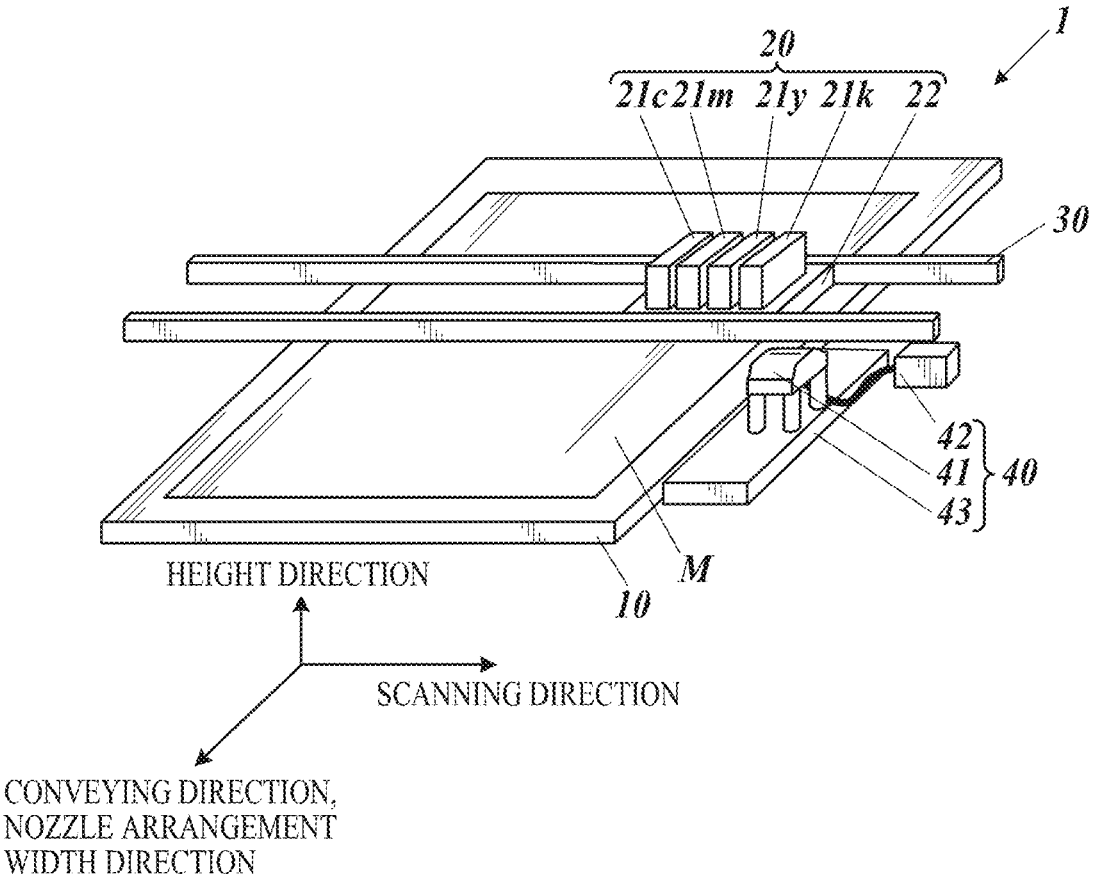
FIG. 1 is an entire perspective diagram showing a configuration of an ink jet recording apparatus according to a first embodiment.

FIG. 1 is an entire perspective diagram showing an ink jet recording apparatus 1 according to a first embodiment of the present invention.

The ink jet recording apparatus 1 includes a conveyor 10, a recording operation unit 20, a scanner 30, and a maintenance unit 40 (ink jet head maintenance apparatus).

The conveyor 10 moves a recording medium M in a predetermined conveying direction, and moves the recording medium M relatively with relation to the recording operation unit 20. The conveyor 10 includes, for example, a conveying belt in which the recording medium M is placed on a placement surface and the placement surface moves in a rotation, and a roller and motor which move the conveying belt in a rotation. However, the conveyor 10 is not limited to the above.

The recording operation unit 20 controls the ink to be discharged from the nozzle to a suitable position on the recording medium M. The recording operation unit 20 includes recording heads 21*c*, 21*m*, 21*y*, 21*k* (ink jet head) and a carriage 22 (base).

Each of the recording heads 21*c*, 21*m*, 21*y*, 21*k* (hereinafter collectively referred to as recording head 21) discharge ink in CMYK (colors cyan, magenta, yellow, and black). The recording heads 21 are held fixed to the carriage 22, and are collectively included in the head unit of the present embodiment. A plurality of nozzles are provided arranged on a surface of the recording head 21 facing the recording medium M (nozzle surface), and pressure is suitably applied to each color of ink to discharge fine ink drops from these nozzles. The recording head 21 (carriage 22) is supported in a state separated a predetermined distance from a conveying surface in a direction that the nozzle surface is orthogonal to the conveying surface (height direction).

The scanner 30 scans the recording operation unit 20 in the direction orthogonal to a conveying direction of the recording medium M (scanning direction). The ink discharged from each nozzle is landed two dimensionally on the image recording surface of the recording medium M according to the movement of the recording head 21 in the scanning direction by the scanner 30 and the movement of the recording medium M in the conveying direction. For example, the scanner 30 includes a rail which supports the carriage 22 in a state in which the nozzle surface is separated the above described predetermined distance from the conveying surface in a height direction. The carriage 22 is able to move along the rail extending along the scanning direction.

The maintenance unit 40 performs cleaning of the nozzle surface of the recording head 21. The maintenance unit 40 includes a suction member 41 and a suction operation unit 42. The suction member 41 is supported and positioned by a supporting stage 43 to the side of the conveying surface of the recording medium M conveyed by the conveyor 10. By moving the supporting stage 43 in a predetermined direction (predetermined second direction) intersecting (here, orthogonal) with a normal direction of the surface including a suction opening 411 (opening surface 415; see FIG. 4A), the maintenance unit 40 is positioned to be able to move relatively with relation to any nozzle surface of the recording head 21 which is to be the target of suction. The suction member 41 is provided with a suction hole 410 (see FIG. 4A) which is connected to the suction opening 411 (other opening) and through which ink and air can pass. The suction operation unit 42 suctions ink with the air from the suction opening 411 by the operation of suction of the air in the suction hole 410 through the tube from the suction opening (one opening) on the opposite side of the suction opening 411 in the suction hole 410.

Figure 2:
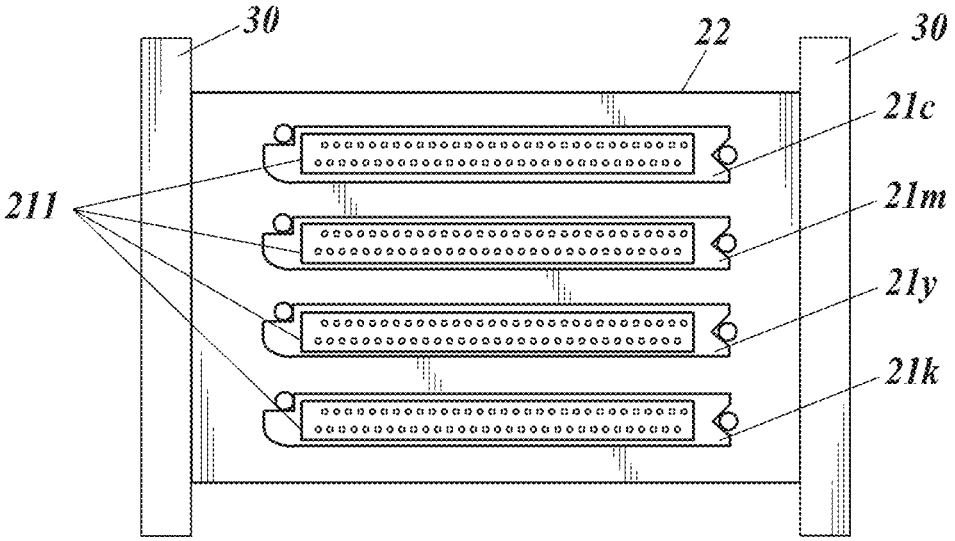
FIG. 2 is a diagram showing an example of an arrangement pattern of nozzle openings on a nozzle surface.

FIG. 2 is a diagram showing an example of an arrangement pattern of the nozzle opening in the nozzle surface.

The nozzle surface of the recording head 21 is provided with a nozzle plate 211 provided with through holes corresponding to the opening positions of each nozzle so that there is communication with each nozzle.

The arrangement pattern of the nozzle opening is not limited. Here, the recording head 21 of each color includes a nozzle arrangement range in which two nozzle rows are provided, each nozzle row provided with a large number of nozzles arranged along a conveying direction (nozzle arrangement width direction). The nozzle opening position of the two rows are provided alternately to be in a zigzag form in the nozzle arrangement width direction (arrangement width direction along a long side of the nozzle arrangement range). The number of nozzles shown in the drawings are for the purpose of description, and the number can be suitably determined.

Figure 3:
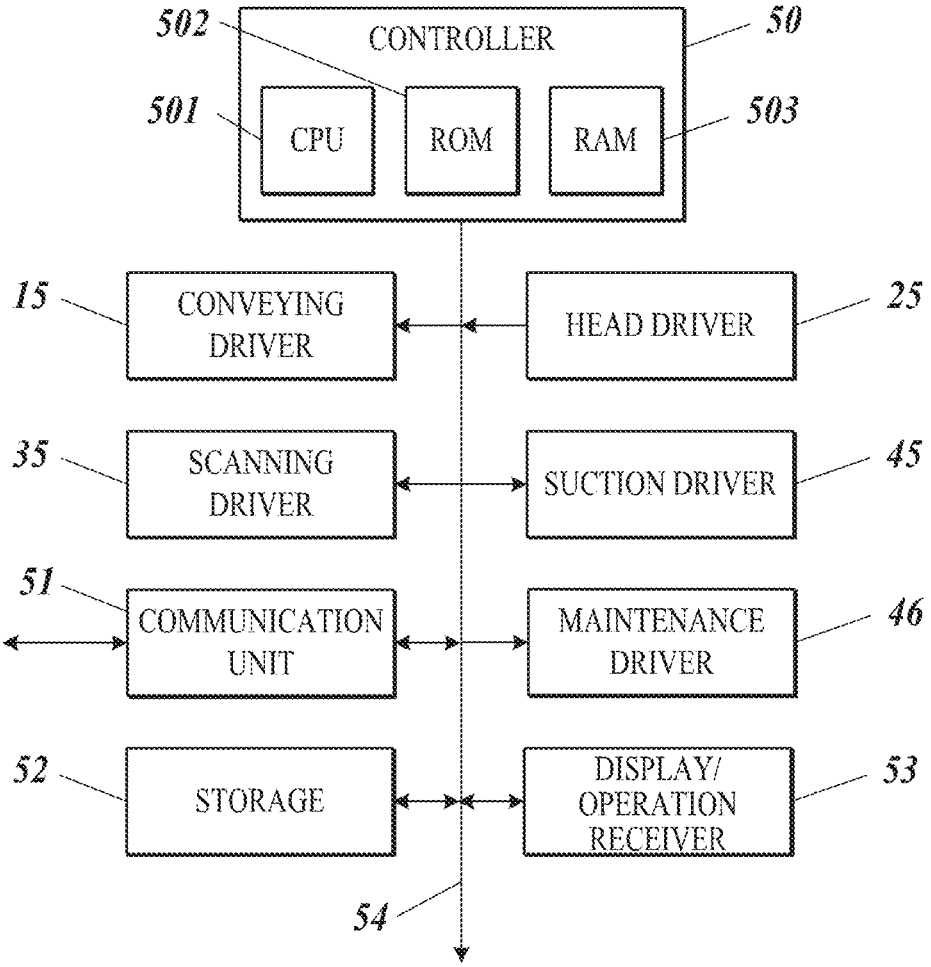
FIG. 3 is a block diagram showing a functional configuration of an ink jet recording apparatus.

FIG. 3 is a block diagram showing a functional configuration of the ink jet recording apparatus 1 according to the present embodiment.

The ink jet recording apparatus 1 includes a conveying driver 15, a head driver 25, a scanning driver 35, a suction driver 45, a maintenance driver 46 (moving operation unit), a controller 50, a communication unit 51, a storage 52, a display/operation receiver 53 and the like.

The conveying driver 15 performs the operation regarding the conveying of the recording medium M by the conveyor 10. As the conveying driver 15, for example, the above described motor is included.

The head driver 25 performs the operation to discharge ink from the nozzle opening of the recording head 21. The head driver 25 deforms an ink chamber to apply a change in pressure to the ink in the ink chamber with ink accumulated, and for example the following are included, a piezoelectric element which deforms according to applied voltage, and a driving circuit which applies voltage to the piezoelectric element.

The scanning driver 35 moves the carriage 22 (recording head 21) along the rail of the scanner 30. The scanning driver 35 may be, for example, a motor which moves a belt fixed to the carriage 22.

The suction driver 45 operates the suction operation unit 42. The suction driver 45 may be, for example, a suction fan.

The maintenance driver 46 moves the suction member 41 and the supporting stage 43 in the above-described second direction relatively with relation to the nozzle surface of the recording head 21 and the carriage 22. The maintenance driver 46 may be a motor which moves a supporting stage 43 which supports the suction member 41 or a belt fixed to the above.

The controller 50 centrally controls the entire operation of the ink jet recording apparatus 1. The controller 50 includes, a CPU 501 (Central Processing Unit), a ROM 502 (Read Only Memory), and a RAM 503 (Random Access Memory).

The CPU 501 performs various calculating processes and performs a control operation. The ROM 502 stores control programs and initial setting data. The RAM 503 provides a memory space for work to the CPU 501, and stores temporary data. The control programs and the initial setting data stored in the ROM 502 are retrieved by the CPU 501 as necessary, loaded to the RAM 503, and executed and utilized. The ROM 502 may include a non-volatile memory which is updatable and rewritable.

The communication unit 51 transmits to and receives from outside data according to a predetermined communication standard through the network. For example, a network card may be employed as the communication unit 51, and communication with external devices is performed through a LAN (Local Area Network; includes wireless LAN) or a router. The communication contents include job data such as instructions for performing image recording operations and image data as targets. The communication unit 51 may include communication terminals for a USB (Universal Serial Bus) cable or a driver.

The storage 52 stores job data obtained from outside or data analyzing and processing the above. The storage 52 may include a volatile memory such as a DRAM and a non-volatile memory. The volatile memory is temporarily used for processes in which the image data included in the job data is converted to image forming data. The non-volatile memory stores job data when the job data is held including terms in which power supply is turned off, and data after processing. The non-volatile memory also stores setting data to update and add to the initial setting data stored in the ROM 502.

The display/operation receiver 53 displays on a display screen a display based on a control operation by the controller 50 and receives input operation from outside such as the user. As the display screen, for example, a liquid crystal display screen may be used, and as the operation receiver, for example, a touch panel provided overlapped with a liquid crystal display screen (touch sensor) may be used. In the configuration related to the display, an LED lamp may be used, and in the configuration related to the reception of operation, numeric keys and press button switches may be provided.

The bus 54 electrically connects the controller 50 with various units, and communicates transmitted and received signals.

Next, the configuration and operation regarding the maintenance operation in the ink jet recording apparatus 1 according to the present embodiment is described.

Figure 4A:
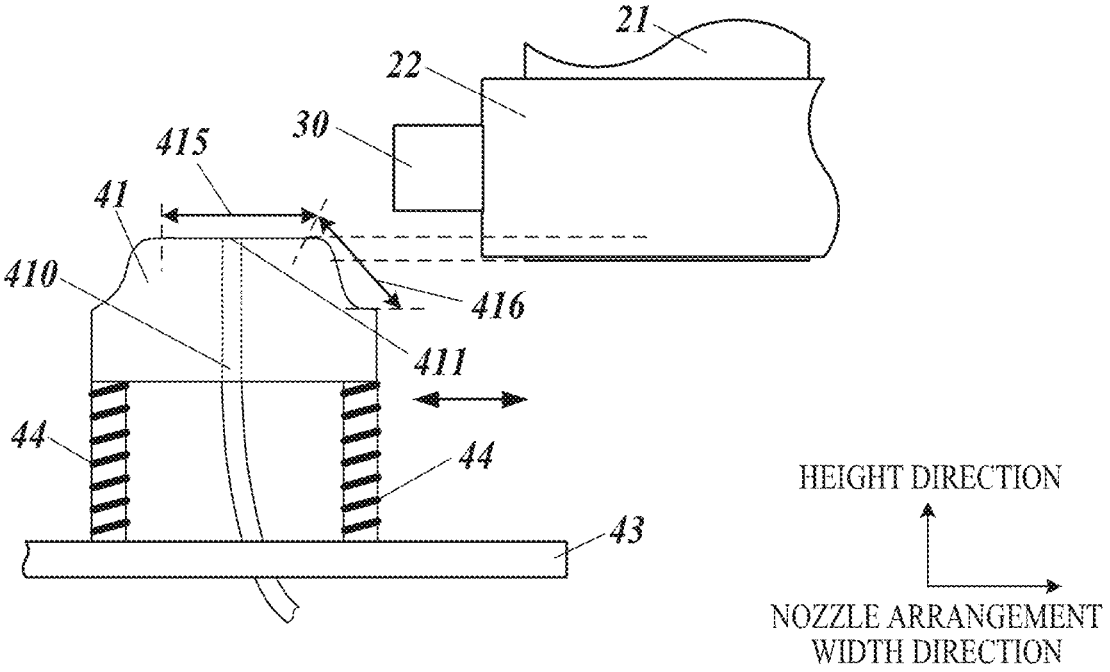
FIG. 4A is a diagram describing a relation of positions between a recording operation unit and a maintenance unit.
Figure 4B:
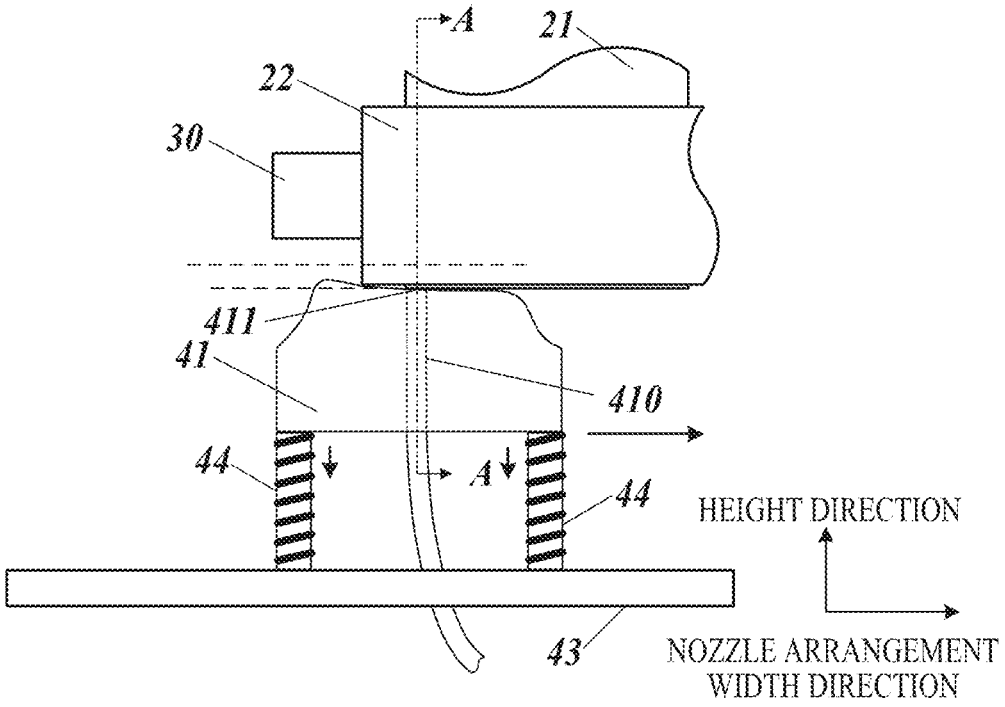
FIG. 4B is a diagram describing a relation of positions between the recording operation unit and the maintenance unit.

FIG. 4A and FIG. 4B are diagrams describing the relation of the positions between the recording operation unit 20 and the maintenance unit 40.

As shown in FIG. 4A, the suction member 41 is provided with a surface (height adjustment surface) which is formed by chamfering so as to include a tilt in the nozzle arrangement width direction with relation to the height direction and which is adjacent to the opening surface 415 provided with the suction opening 411. Here, such height adjustment surface is a curved shape, and the interior angle between the tangent line of each point and the opening surface 415 (angle on the inner side of the suction member 41) is an obtuse angle (larger than 90 degrees and smaller than 180 degrees).

The suction member 41 is supported by the supporting stage 43 with leg portions 44 in between. One end of each leg portion 44 is connected to the suction member 41 and the leg portion 44 extends in the height direction. In the leg portion 44, the position (positions of the opening surface) in the direction (first direction, here, equal to height direction) including the height direction of the suction member 41 (opening surface) is able to expand and contract in response to external force applied to the suction member 41. For example, a spring like member which expands and contracts in the height direction is provided around a core member in which the deforming in the scanning direction and the nozzle arrangement width direction is suppressed and expansion and contraction in the height direction is possible (includes a member which is pushed inside the suction member 41 and the length of an exposed portion is changed). The suction member 41 may include an elastic member which can expand and contract in the height direction. As the suction member 41, a well-known resin material which is widely used in conventional maintenance apparatuses can be used. The supporting unit of the present embodiment includes the supporting stage 43 and the leg portion 44.

The supporting stage 43 at least extends in the nozzle arrangement width direction, and is able to move in a straight line (one dimensionally) in the nozzle arrangement width direction (second direction) by the maintenance driver 46. The suction member 41 moves in the nozzle arrangement width direction together with the movement of the supporting stage 43. In the standby state of the maintenance unit 40, the suction member 41 stops in the predetermined standby position in the state separated (no-contact state) from the head unit (recording head 21 and carriage 22).

Here, the opening surface 415 and the nozzle surface 21*a* are provided parallel. Therefore, the nozzle arrangement width direction (second direction) which is the moving direction of the suction member 41 and the supporting stage 43 is a direction parallel with the nozzle surface 21*a*.

In the normal initial state, that is, in the state in which the suction member 41 is not deformed and the leg portion 44 is not expanded or contracted (predetermined initial state), the suction member 41 is positioned to be in a position so that the upper surface in the height direction is lower than the nozzle surface 21*a* of the recording head 21 in the height direction. Therefore, if the supporting stage 43 and the suction member 41 move from the standby position in the nozzle arrangement width direction, the suction member 41 comes into contact with the head unit (first the carriage 22, and then the recording head 21).

As shown in FIG. 4B, when the suction member 41 moves from the standby position in the nozzle arrangement width direction and comes into contact with the head unit (carriage 22 and recording head 21), since the height adjustment surface 416 which is the contact surface of the suction member 41 is tilted in the height direction, a force with a downward component in the height direction is applied to the suction member 41 (portion of the height adjustment surface 416 which is in contact with the head unit), and the suction member 41 and the leg portion 44 are contracted according to the elasticity of the suction member 41 and the elasticity of the leg portion 44. With this, the position of the upper surface of the suction member 41 is changed downward. Then, the suction member 41 slides under the nozzle surface (ink discharge surface in which the nozzle opening of the nozzle plate 211 is provided) with the further movement in the nozzle arrangement width direction, and the upper surface of the suction member 41 faces and comes into contact with the nozzle surface while being biased upward (direction of the nozzle surface). Then, the suction member 41 is moved in the nozzle arrangement width direction in the state being biased and in contact with the nozzle surface (head unit). That is, the total maximum contraction amount (movable amount in the first direction) of the suction member 41 and the leg portion 44 needs to be equal to or more than the amount that the opening surface 415 and the nozzle surface do not come into contact (usually, larger than this amount). According to such state facing each other, the maintenance unit 40 is able to perform suction of ink from the nozzle surface.

Figure 5A:
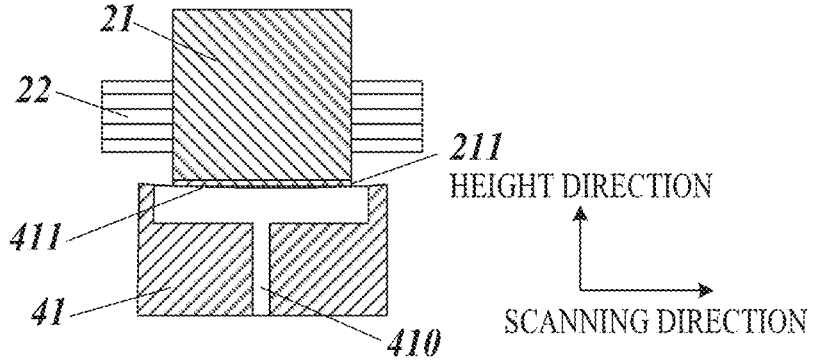
FIG. 5A is a cross-sectional diagram showing the recording operation unit and the maintenance unit.

FIG. 5A is a cross-section diagram along the cross-section line A-A shown in FIG. 4B.

In this cross-section, the width of the suction opening 411 is wider than the width of the recording head 21 in the scanning direction (third direction orthogonal to the nozzle arrangement width direction on the nozzle surface). That is, through such suction member 41, the attached ink is suctioned from not only the portion where there is the nozzle opening but also from the entire nozzle surface.

Figure 5B:
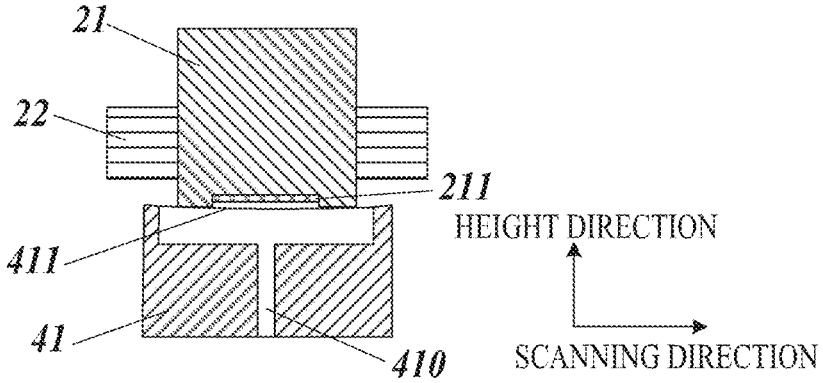
FIG. 5B is a cross-sectional diagram showing the modification of the recording operation unit and the maintenance unit.

FIG. 5B is a modification of a cross-section diagram along the cross-section line A-A.

In this cross-section, the nozzle surface is formed with the center portion (one portion) including the nozzle opening depressed in a concave shape compared to the surrounding portion, and a nozzle plate 211 is provided inside the depressed portion. Due to such shape, the nozzle plate 211 does not come into direct contact with the suction member 41, the peripheral portion of the nozzle surface comes into contact with the suction member 41 in a shape surrounding the concaved potion, and the possibility of damaging the nozzle opening is reduced without the suction power decreasing.

Figure 5C:
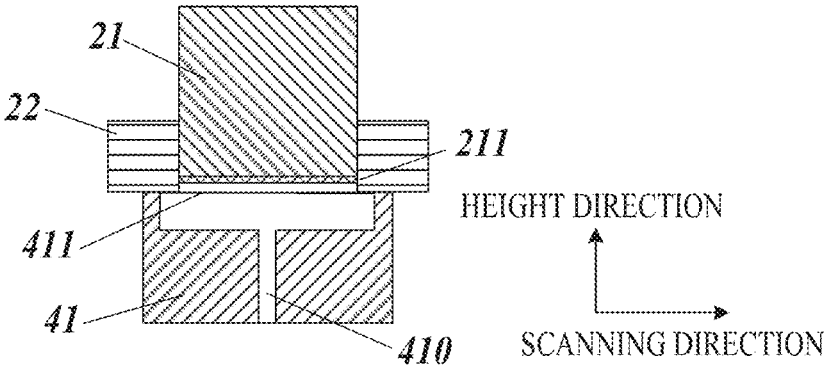
FIG. 5C is a cross-sectional diagram showing another modification of the recording operation unit and the maintenance unit.

FIG. 5C is another modification of the cross-section diagram along the cross-section line A-A.

According to this cross-section, the lower surface of the carriage 22 is positioned lower in the height direction than the nozzle surface. That is, the suction member 41 comes into contact with the lower surface of the carriage 22 but does not come into contact with the nozzle surface (nozzle plate 211). If the positions are in such relations, when the nozzle plate 211 is fixed to the carriage 22, the carriage 22 and the contacting portion of the suction member 41 surrounds the nozzle plate 21. With this, the possibility of damaging the nozzle opening is reduced without the suction power decreasing.

Figures 6, 7:
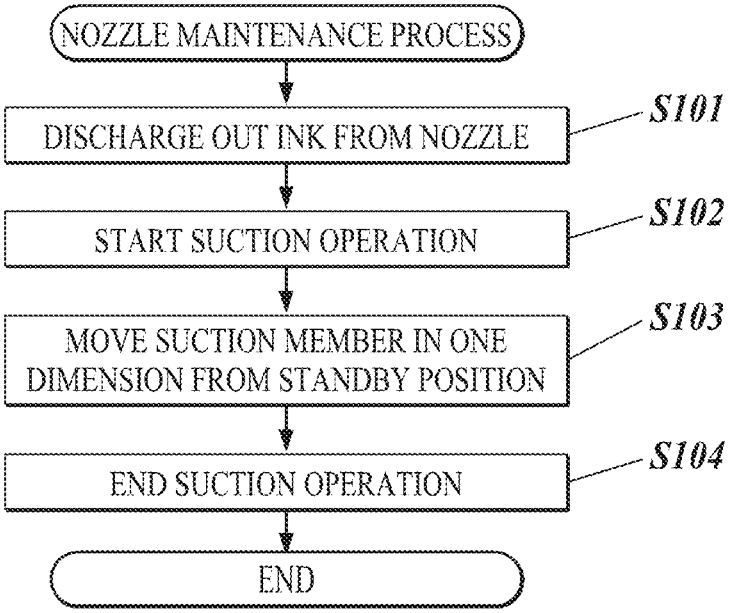
FIG. 6 is a flowchart showing steps for controlling a nozzle maintenance process performed in the ink jet recording apparatus.
FIG. 7 is a table showing an example of a result of maintenance performed in the ink jet recording apparatus with relation to a moving speed of a suction member.

FIG. 6 is a flowchart showing a control process by the controller 50 in the nozzle maintenance process executed in the ink jet recording apparatus 1 according to the present embodiment.

For example, the nozzle maintenance process starts automatically in occasions such as before the image recording operation starts, or when the operation is paused or ends. Alternatively, the nozzle maintenance process starts in response to a predetermined input on the display/operation receiver 53 by the user.

When the nozzle maintenance process starts, the controller 50 (CPU 501) outputs the control signal to the head driver 25 and discharges out (purges) ink from the nozzle which is the target of maintenance (step S101). Here, the controller 50 moves an ink tray (not shown) in a position facing the nozzle surface to receive the discharged ink.

The controller 50 outputs the control signal to the suction driver 45, and starts the suction by the suction operation unit 42 (step S102). The controller 50 outputs the control signal to the maintenance driver 46 and moves the suction member 41 one-dimensionally from the standby position to the nozzle arrangement width direction (step S103). The controller 50 waits for the suction member 41 to return to the standby position, outputs the control signal to the suction driver 45, and ends the suction operation by the suction operation unit 42 (step S104). Then, the controller 50 ends the nozzle maintenance process.

FIG. 7 is a table showing an example of the result of the maintenance performed in the ink jet recording apparatus 1 according to the present embodiment with relation to the moving speed (sweeping speed) of the suction member 41.

When the sweeping speed is not yet large, the ink on the nozzle surface is suitably suctioned, and a sufficient maintenance effect can be achieved (circle). When the sweeping speed becomes faster (here, 70 mm/sec or more), the residual liquid can be seen on the nozzle surface (triangle). When the sweeping speed becomes a certain degree or higher (here, 100 mm/sec or more), a sufficient ink suction effect cannot be achieved (X-mark).

Such results change depending on various conditions such as ink material, size of ink jet head, state of protective film of the nozzle surface, magnitude of suction power, size of suction opening, material of suction member, width, and magnitude of biasing power, and it is qualitative. In the ink jet recording apparatus 1, considering the amount of time consumed for maintenance, a sweeping speed as fast as possible may be set within a range that a sufficient maintenance effect can be achieved according to the various conditions. That is, the controller 50 may change the setting of the sweeping speed for each maintenance operation according to the ink type. Alternatively, the sweeping speed may be determined uniformly simply assuming the worst conditions.

Figure 8A:
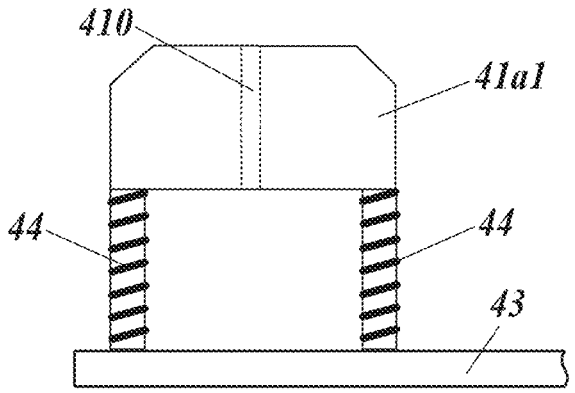
FIG. 8A is a diagram showing a modification of the maintenance unit.
Figure 8B:
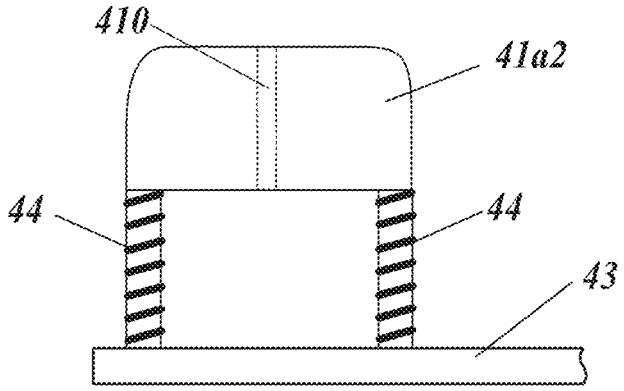
FIG. 8B is a diagram showing a modification of the maintenance unit.

FIG. 8A and FIG. 8B are diagrams showing a modification of a maintenance unit 40.

The shape of the suction member 41 at both ends in the nozzle arrangement width direction is not limited to the shape shown in FIG. 4, and may be any shape which softens the impact when coming into contact with the recording head 21 and the carriage 22 while providing force to push down the suction member 41. For example, as shown in FIG. 8A, the suction member 41*a*1 may be a shape tilted to a certain angle with relation to the nozzle surface, or as shown in FIG. 8B, the suction member 41*a*2 may be a curve in a convex shape curved upward.

Figure 9A:
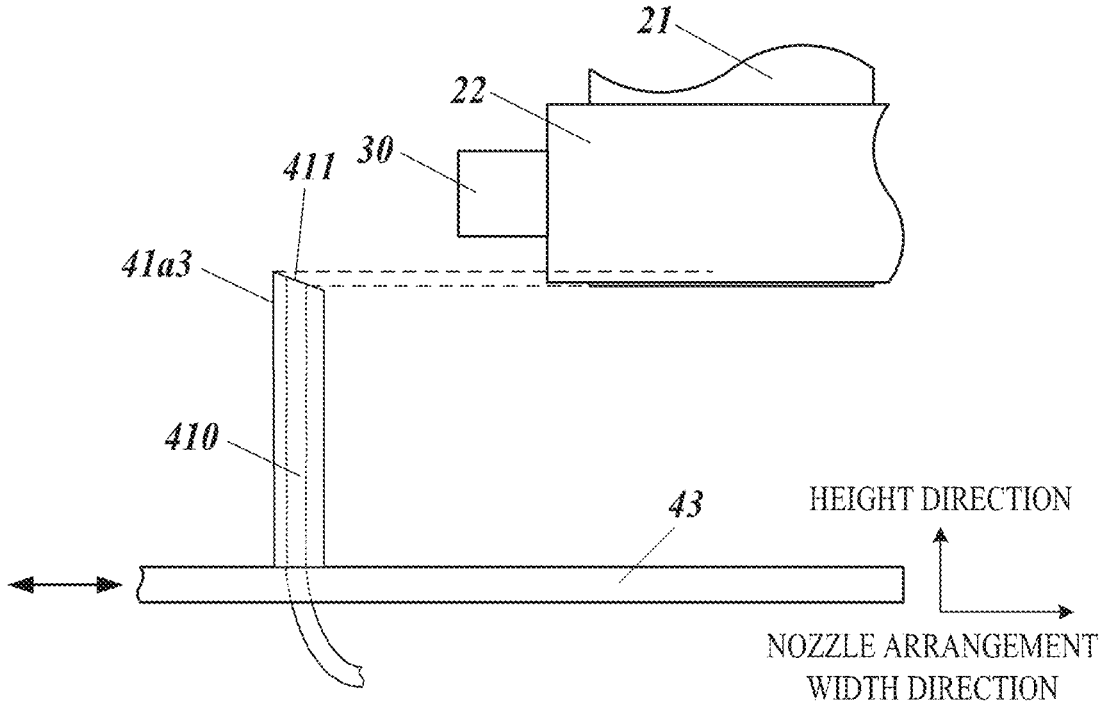
FIG. 9A is a diagram showing another modification of the maintenance unit.
Figure 9B:
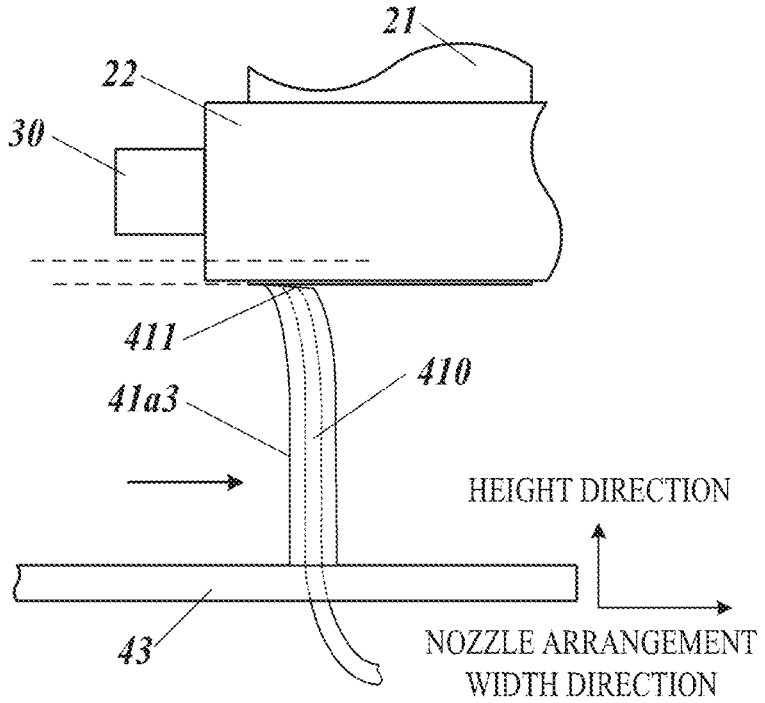
FIG. 9B is a diagram showing another modification of the maintenance unit.

FIG. 9A and FIG. 9B are diagrams showing another modification of the maintenance unit 40.

According to such modification, as shown in FIG. 9A, leg portions 44 are not provided to the suction member 41*a*3, and the lower surface of the suction member 41*a*3 including the elastic member is directly fixed to the supporting stage 43. In addition to deforming in the expanding and contracting direction, the suction member 41*a*3 is able to deform by bending and shearing. The suction member 41*a*3 is provided so that the opening surface of the suction member 41*a*3 is tilted with relation to the nozzle surface in the standby state (initial state) (the outward normal direction of the opening surface and the outward normal direction of the nozzle surface form an obtuse angle). As shown in FIG. 9B, by coming into contact with the nozzle surface or the carriage 22 (head unit), the suction member 41*a*3 moves so as to tilt bent in the direction opposite to the moving direction in the nozzle arrangement width direction (move in first direction), and with this, the height is shortened. According to this tilt, the upper surface becomes close to parallel with relation to the nozzle surface, and with this, the suction efficiency is enhanced.

As described above, the maintenance unit 40 including the ink jet recording apparatus 1 according to the first embodiment includes the suction hole 410 for ink, and the suction member 41 with which suction of air in the suction hole 410 is performed from one opening of the suction hole 410 by the suction operation unit 42. The suction member 41 includes the height adjustment surface 416 which is adjacent to the opening surface 415 and in which the inner angle formed between the opening surface 415 is an obtuse angle. In response to the external force applied to the height adjustment surface 416, the positions on the opening surface 415 can move in a first direction including the normal direction of the opening surface 415, here the height direction.

According to such configuration, even if the moving direction of the suction member 41 by the maintenance driver 46 such as the motor is only a one-dimensional operation, the movement in the height direction which is the direction to come into contact with the nozzle surface is naturally achieved by the structure using a spring or the like. Therefore, the ink on the nozzle surface can be easily suctioned with an easily obtained configuration controlled easily. Moreover, regarding the movement in the height direction, the height adjustment surface 416 is provided tilted in the suitable direction with relation to the second direction in order to convert the contact between the suction member 41 and the head unit according to the one-dimensional operation to the change in position in the height direction. With this, the nozzle surface can face the opening surface easily and reliably while avoiding excessive impact on the head unit. Due to such tilt, the ink in contact with the height adjustment surface 416 is suitably guided to the suction opening 411 and effectively and reliably suctioned. Therefore, the configuration and the control of such maintenance unit 40 becomes simple.

The height adjustment surface 416 is provided in a position which comes into contact with the head unit when the supporting unit is attached to the ink jet recording apparatus 1 provided with the head unit including the recording head 21 which is the target of ink suction and the suction member is moved from the predetermined standby position in the nozzle arrangement width direction (direction intersecting with the normal direction of the opening surface 415 and the second direction). The suction member 41 is able to move in the height direction to the position where the height adjustment surface 416 does not come into contact with the head unit.

As described above, if the height adjustment surface 416 suitably comes into contact with the head unit by the one-dimensional operation of the suction member 41, the suction member 41 easily moves in the height direction and the opening surface faces the nozzle surface. With this, the maintenance regarding the suction of ink can be performed with an easy configuration and control.

The supporting unit (leg portion 44) includes a spring shaped member extending along a height direction with one end connected to the suction member 41. The spring shaped member extends and contracts in response to external force applied in the height direction.

According to such expanding and contracting configuration, the movement in the height direction surely occurs only when force is received from the head unit, and when the maintenance operation ends which means being separated from the head unit, the position returns to the original position in the height direction. Therefore, there is no burden in such repeated operation, and the operation is easy. The configuration is simple, and malfunction rarely occurs. Even if malfunction occurs, easy determination is possible, and the cost is cheap so exchange is easy.

The suction member 41 includes an elastic member and expands and contracts in response to the component of the external force in the height direction applied to the suction member 41. As described above, not only the leg portion 44 but also the suction member 41 itself is able to extract and contract. Therefore, flexible extraction, contraction, and deforming is possible, and unnatural force applied when moving in the height direction can be suppressed. Moreover, the impact when the suction member 41 and the head unit come into contact can be suppressed.

The height adjustment surface 416 is a curved shape. With this, it is possible to smoothly switch from the contact state between the height adjustment surface 416 and the head unit to the contact state between the opening surface and the head unit. Therefore, it is possible to suppress the impact which is applied or prevent being caught when there is a change in the contact state.

In the maintenance unit 40 according to the modification shown in FIG. 9A and FIG. 9B, the suction member 41 includes an elastic member. In response to the external force applied to the opening surface 415, when the maintenance unit 40 is attached to the ink jet recording apparatus 1, the suction member 41 deforms so that the positions on the opening surface are able to move in the direction including the height direction intersecting (orthogonal) to the nozzle arrangement width direction which is to be the relative moving direction between the suction member 41 and the recording head 21.

As described above, even if the leg portion 44 is not provided, by using an elastic member as the suction member 41, the opening surface can be suitably moved in the height direction controlled only with a one-dimensional operation by the above-described maintenance driver 46 so as to face the nozzle surface. Then, the suction operation of the ink can be performed. Therefore, the configuration and the control process becomes easy.

The opening surface is provided in a position which comes into contact with the head unit when the maintenance unit 40 is attached to the ink jet recording apparatus 1 provided with a head unit including the recording head 21 as the ink suction target and the suction member is moved from the predetermined standby position to the nozzle arrangement width direction. The suction member 41 is able to move in a height direction to a position where the opening surface does not come into contact with the head unit.

That is, in this case, the opening surface and the head unit directly bend right and the suction member 41 deforms (here, mainly deforming by bending), and the position changes so that the opening surface faces the nozzle surface.

Therefore, the configuration of the maintenance unit 40 and the process regarding the maintenance operation becomes easy.

The opening surface is provided so that the outward normal direction in the initial state forms an obtuse angle with the outward normal direction of the ink discharge surface of the recording head 21.

With this, when the opening surface comes into contact with the head unit and the suction member 41 deforms in a bent shape, the state changes so that the opening surface faces the ink discharge surface suitably in a substantial parallel state. Therefore, the configuration is easy. In this case, it is easy to adjust so that the opening surface is not completely parallel to the ink discharge surface. With this, the maintenance unit 40 does not splash the ink on the nozzle surface more than necessary and it is possible to avoid unnecessary damage to the protective film such as a water repellent film on the nozzle surface.

The deforming of the suction member 41 includes deforming by bending in the nozzle arrangement width direction. The impact of the contact with the head unit occurring by the suction member 41 moving in the nozzle arrangement width direction becomes small by such deforming by bending. Since the opening surface 415 moves in the combined direction (first direction) of the nozzle arrangement width direction and the height direction, the burden on the head unit and the ink jet recording apparatus 1 can be further reduced.

The maintenance unit 40 includes the suction operation unit 42. Therefore, the suction power can be suitably controlled and the suction of the ink can be performed reliably.

The maintenance unit 40 includes a maintenance driver 46 which moves the suction member 41 in the nozzle arrangement width direction. By moving the suction member 41 which is drastically lighter and has a smaller size compared to the head unit, the suction member 41 is moved relative to the head unit, and the process regarding maintenance can be performed easily.

The width of the suction opening 411 in the scanning direction orthogonal to the nozzle arrangement width direction in the opening surface is wider than the width of the ink discharge surface in the scanning direction on the recording head 21 set in advance as the ink suction target. With this, not only the ink in the nozzle but all of the ink attached to the nozzle surface can be reliably suctioned and effective maintenance can be performed.

The ink jet recording apparatus 1 according to the present embodiment includes the above-described maintenance unit 40 and the recording head 21 provided with a nozzle which discharges ink. The maintenance unit 40 is provided so that when moved from the predetermined standby position to the nozzle arrangement width direction and when moved from the predetermined initial position in the height direction, the opening surface 415 faces the ink discharge surface so as to be able to suction ink on the ink discharge surface. As described above, by employing the maintenance operation with the above-described maintenance unit 40 attached to the ink jet recording apparatus 1, the configuration regarding the maintenance becomes simple, and the control of the operation becomes easy. Therefore, while being able to perform suitable maintenance, the costs regarding the maintenance unit 40 itself and the controller for control are reduced, and the configuration can be made smaller.

The second direction is the direction parallel to the nozzle surface, and the maintenance driver 46 moves the suction member 41 in the second direction. With this, the opening surface 415 and the nozzle surface can easily and evenly come into contact with each other.

The moving direction of the suction member 41 moved by the maintenance driver 46 is the nozzle arrangement width direction along the long side of the nozzle arrangement range on the nozzle surface. With this, the cleaning operation of the entire nozzle surface can be performed efficiently without making the size of the suction member 41 large.

After moving in the height direction of the opening surface 415, the suction member 41 is moved in the nozzle arrangement width direction biased in the nozzle surface direction. The suction member 41 which moves in the height direction due to the elastic force of the elastic member and the spring maintains the state biased in the nozzle surface direction. Therefore, the opening surface 415 and the nozzle surface easily and reliably maintain a state facing each other at a suitable distance and stable maintenance operation can be performed.

The nozzle surface is formed in a concave state with one portion including the nozzle opening depressed with relation to the other surrounding portions. With this, even if the suction member 41 is biased in the nozzle surface direction, the suction member 41 does not come into contact with the nozzle opening and its surroundings. Therefore, problems such as damaging the nozzle opening and its surroundings and peeling the surrounding protective film hardly occurs, and the life of the head unit is not shortened. Moreover, the nozzle opening is surrounded by the nozzle surface and the surrounding portion and air tightness is high. Therefore, the suction of ink can be performed efficiently.

A carriage 22 which fixes and holds the recording head 21 is provided. The suction member 41 comes into contact with the carriage 22 by moving in the nozzle arrangement width direction from the predetermined standby position (movement relative to the recording head 21), and the opening surface moves in the height direction in response to the external force applied to the portion in contact. As described above, the suction member 41 does not come into direct contact with the recording head 21 and the nozzle plate 211 to move in the height direction. Therefore, it is possible to further reduce the possibility of damaging or distorting the recording head 21 and the nozzle plate 211.

The recording head 21 is fixed by the carriage 22 maintained in a state in which the suction member 41 faces the nozzle surface, the suction member 41 comes into contact with the carriage 22, and the recording head 21 itself does not come into contact with the suction member 41. Therefore, the recording head 21 does not come into any contact with the suction member 41 while maintenance is performed, and there is no need to be concerned about damaging or distorting the recording head 21.

Second Embodiment

Next, the ink jet recording apparatus according to the second embodiment is described.

Figure 10:
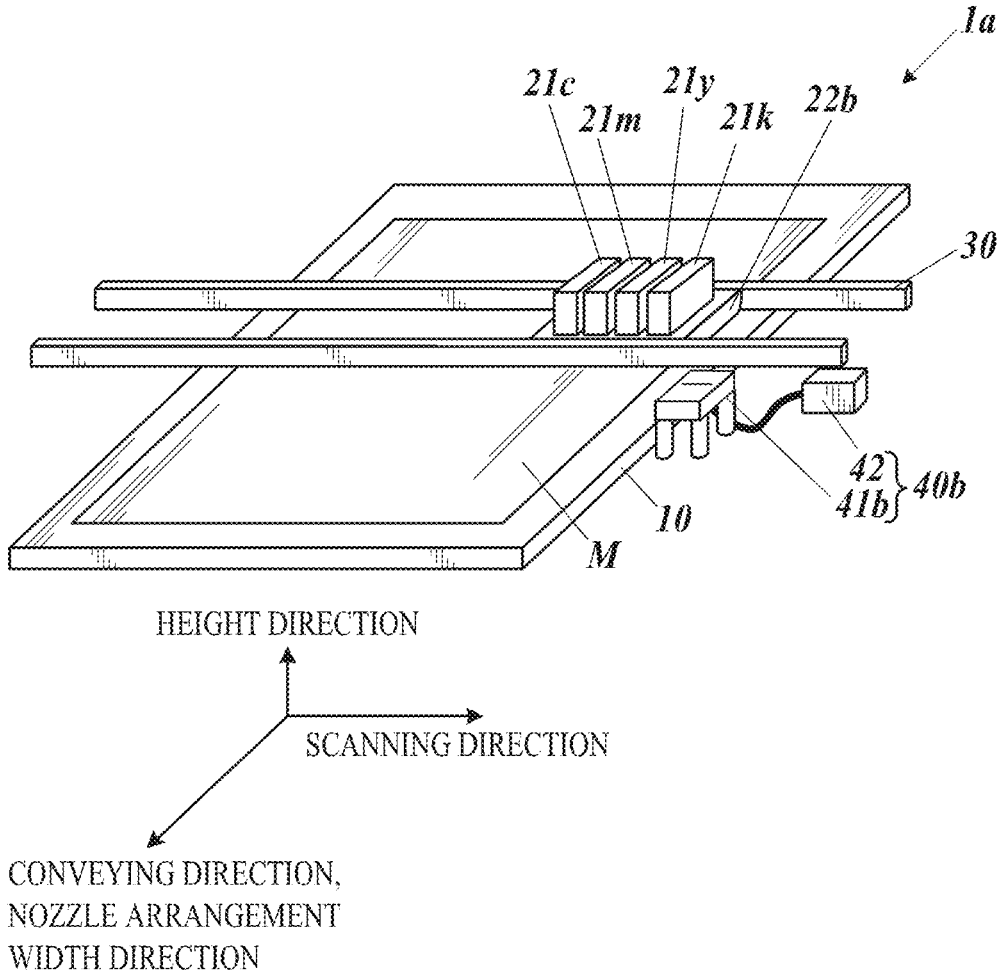
FIG. 10 is an entire perspective diagram showing a configuration of an ink jet recording apparatus according to the second embodiment.

FIG. 10 is an entire perspective view showing a configuration of an ink jet recording apparatus 1*a* according to the second embodiment.

According to the ink jet recording apparatus 1*a* of the present embodiment, the upper surface of the suction member 41*b* in the maintenance unit 40*b* is provided parallel to the nozzle surface. On the lower surface side of the carriage 22*b*, a surface tilted with relation to the upper surface of the suction member 41*b* (the angle formed by the surfaces facing each other is to be an acute angle) (chamfered surface) is provided on the size which comes into contact with at least the suction member 41*b* first in the nozzle arrangement width direction (here, the side which comes into contact last also).

The other structures are the same as the ink jet recording apparatus 1 according to the first embodiment. Therefore, the same reference numerals are used and the description is omitted.

Figure 11A:
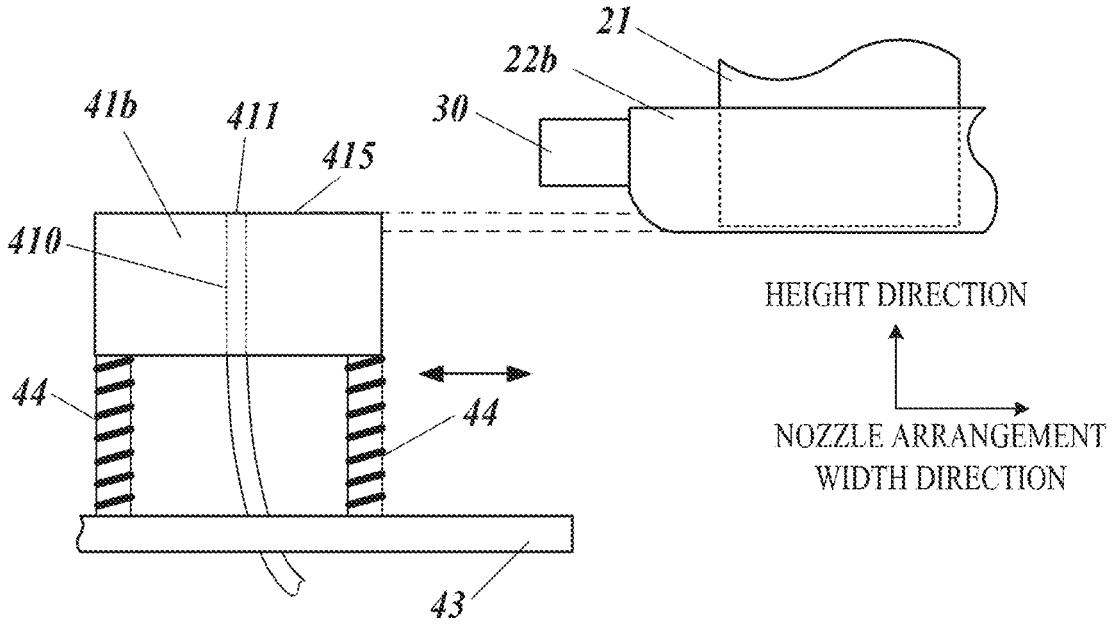
FIG. 11A is a diagram describing a relation of positions between the recording operation unit and the maintenance unit according to a second embodiment.
Figure 11B:
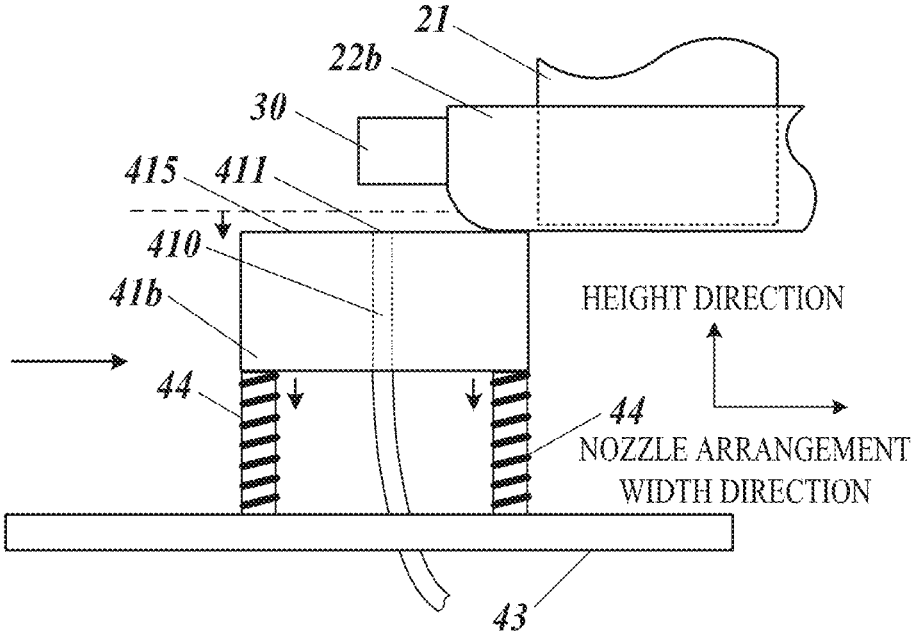
FIG. 11B is a diagram describing a relation of positions between the recording operation unit and the maintenance unit according to a second embodiment.

FIG. 11A and FIG. 11B are diagrams describing the relation of the positions between the recording operation unit 20 and the maintenance unit 40*b*.

As shown in FIG. 11A, the upper surface of the suction member 41*b* is determined to be in a position higher than the lower surface of the 22*b* in the height direction when not in contact with the carriage 22*b*. When the suction member 41*b* moves in the nozzle arrangement width direction with the movement of the supporting stage 43, the suction member 41*b* comes into contact with the portion provided tilted with relation to the orthogonal direction among the outer surfaces of the carriage 22*b*.

The suction member 41*b* receives force downwards in the height direction from the portion contacting with the carriage 22*b*, and the leg portion 44*b* contracts so that the position of the opening surface 415 of the suction member 41*b* changes. As shown in FIG. 11B, the leg portion 44 contracts until the suction member 41*b* goes under the carriage 22*b*. Then, the suction member 41*b* (opening surface 415) receives pressure in the height direction by the leg portion 44 and slides biased against the carriage 22*b*. The suction member 41*b* suctions the ink of the carriage 22*b* and the nozzle surface 21*a* and moves in the nozzle arrangement width direction. Here, the suction member 41*b* does not come into contact with the nozzle surface 21*a*.

As described above, if the contact surface between the suction member 41*b* and the carriage 22*b* is tilted in the height direction on the carriage 22*b* side and it is possible to apply downward force to the suction member 41*b*, the suction member 41*b* does not have to be tilted with respect to the height direction.

As described above, the ink jet recording apparatus 1 according to the second embodiment includes the maintenance unit 40 of the recording head 21, the maintenance unit 40 including the suction member 41 including the ink suction hole 410 and a suction operation unit 42 which suctions air in the suction hole 410 from one opening of the suction hole 410. The maintenance unit 40 is able to move in a first direction including a normal direction of the opening surface 415 (here, height direction) in response to external force applied to the suction member 41 by the positions of the opening surface 415. The ink jet recording apparatus 1 also includes the head unit including the recording head 21 provided with the nozzle which discharges ink and the carriage 22 which holds the recording head 21 in a fixed state. According to the maintenance unit 40, the suction member 41 moves from the predetermined standby position in the nozzle arrangement width direction and the suction member 41 moves in the height direction from the initial state in response to external force applied by the contact with the carriage 22*b*. With this, the opening surface is positioned so as to face the nozzle surface in which the nozzle opening of the recording head 21 is provided and is able to suction ink on the nozzle surface. The carriage 22*b* is shaped so that the angle formed by (between) the surface which first comes into contact with the suction member 41 in response to the movement in the nozzle arrangement width direction and the opening surface is the acute angle. The surface which comes into contact may be a curved surface, and in this case, the relation between the opening surface and the outward plane of the carriage 22*b* where contact with the carriage 22*b* is made at each point on the curved surface is each within a range of the acute angle.

As described above, by forming the tilted surface with relation to the nozzle arrangement width direction in the carriage 22*b* instead on the suction member 41 side, by positioning this surface to come into contact with the suction member 41 first, the impact at the time of contact can be suppressed, and the force in the nozzle arrangement width direction can be changed to the force to change the position of the suction member 41 in the height direction and the movement can be performed. With this, the maintenance operation of the nozzle can be performed efficiently and suitably with the simple configuration and control similar to the first embodiment.

The present invention is not limited to the above embodiments and various changes are possible.

For example, according to the above embodiment, the recording medium M is conveyed on the horizontal surface, ink is discharged vertically downward from the recording head 21, and the suction member 41 moves in the horizontal direction, however each of the above can be tilted.

According to the above embodiment, the suction member 41 moves with respect to the recording head 21, but even when the recording head 21 moves with respect to the suction member 41, if the suction member 41 is able to similarly move in the height direction, the present invention can be applied.

According to the present embodiment, the suction member 41 moves parallel with relation to the nozzle surface, but the relative moving direction (predetermined second direction) can be slightly tilted as long as the contact state can be maintained and the opening surface 415 can suitably move by the contact.

According to the present embodiment, the leg portion 44 which supports the suction member 41 is provided vertically downward. However, this may be other connection positions or directions. For example, members can be provided on both side surfaces and the movement may be performed downwards. Alternatively, the predetermined initial state is not limited to the state which is not expanded or contracted, and a slightly contracted state may be assumed to be balanced with gravity.

According to the first embodiment, the opening surface 415 of the suction member 41 is described as being parallel with relation to the nozzle surface, but if the opening surface 415 is suitably facing the nozzle surface and the ink can be suctioned, the opening surface 415 does not have to be parallel with relation to the nozzle surface.

According to the present embodiment, both sides in the nozzle arrangement width direction are tilted with relation to the opening surface (chamfered) to provide the height adjustment surface. However, if the suction member 41 does not move to the opposite side of the nozzle surface at the end of the downstream side in the nozzle arrangement width direction, the height adjustment surface on the opposite side (upstream side) does not have to be provided.

According to the present embodiment, the suction member 41 moves in the nozzle arrangement width direction but the direction is not limited to such direction. If the maintenance operation of the nozzle surface can be suitably performed, the movement can be made in a different direction. The arrangement pattern of the nozzle in the nozzle arrangement range can be freely determined.

According to the present embodiment, the suction member 41 is provided supported by the supporting stage 43, and the suction member 41 moves together with the supporting stage 43. Alternatively, the suction member 41 can be provided directly on a rail and moved.

According to the present embodiment, the width in the scanning direction of the suction opening 411 is wider than the width in the scanning direction of the recording head 21, but rather can be narrower. In this case, maintenance may be performed only in the area near the nozzle opening or the entire maintenance operation may be performed together with the movement in the nozzle arrangement width direction a plurality of times.

According to the present embodiment, the height adjustment surface 416 and the tilted surface are provided only on either the opening surface 415 or the nozzle surface, but the above can be provided on both.

According to the present embodiment, the suction operation unit 42 is included in the maintenance unit 40 (maintenance apparatus of the present embodiment), but the above does not have to be included. The suction operation unit regarding another configuration can also be used for suction from the opening of the suction member 41, or the suction operation unit 42 can be simply provided independent from the suction member 41 and while maintaining the suction operation unit 42, the suction member 41 as the maintenance apparatus can be exchanged.

The ink jet recording apparatus 1 is not limited to a scanning method which records an image while scanning with the recording head 21 and may include a line head.

Other than the above, the specific configuration, shape, and structure, and the specific details such as the positions or contents of the operation as described in the above embodiments can be suitably modified without leaving the scope of the present invention.

INDUSTRIAL APPLICABILITY

The present invention can be used in a maintenance apparatus of the ink jet head and the ink jet recording apparatus.

REFERENCE SIGNS LIST

1, 1*a* ink jet recording apparatus
10 conveyor
15 conveying driver
20 recording operation unit
21, 21*c*, 21*m*, 21*y*, 21*k* recording head
21*a* nozzle surface
211 nozzle plate
22, 22*b* carriage
25 head driver
30 scanner
35 scanning driver
40, 40*b* maintenance unit
41, 41*a*1 to 41*a*3, 41*b* suction member
410 suction hole
411 suction opening
415 opening surface
416 height adjustment surface
42 suction operation unit
43 supporting stage
44 leg portion
45 suction driver
46 maintenance driver
50 controller
501 CPU
502 ROM
503 RAM
51 communication unit
52 storage
53 display/operation receiver
54 bus
M recording medium

The invention claimed is:

1. An ink jet head maintenance apparatus comprising:

a suction member which includes a suction hole to suction ink and in which air in the suction hole is suctioned from one opening of the suction hole by a suction operation unit, wherein, the suction member includes a height adjustment surface which is adjacent to an opening surface in which the other opening of the suction hole is provided and in which an inner angle formed with the opening surface is an obtuse angle, and each position of the opening surface is able to move in a first direction including a normal direction of the opening surface in a predetermined initial state in response to external force applied to the height adjustment surface;

a supporting stage operably connected to the suction member to support the suction member; and a plurality of leg portions extending between the supporting stage and the suction member, each leg portion including a spring member that expands and contracts in response to the external force in the first direction.

2. The ink jet head maintenance apparatus according to claim 1, wherein, the height adjustment surface is provided in a position which comes into contact with a head unit when the maintenance apparatus is attached to an ink jet recording apparatus provided with a head unit including an ink jet head which is to be a target of suction of ink and when the suction member moves relatively in a predetermined second direction intersecting with the normal direction and the first direction in a relative motion with relation to the ink jet head from a predetermined standby position, and the suction member can move in the first direction up to a position where the height adjustment surface does not come into contact with the head unit.

3. The ink jet head maintenance apparatus according to claim 1, wherein the suction member includes an elastic member and the suction member expands and contracts in response to the external force in the first direction.

4. The ink jet head maintenance apparatus according to claim 1, wherein the height adjustment surface is a curved surface shape.

5. The ink jet head maintenance apparatus according to claim 1, further comprising the suction operation unit.

6. The ink jet head maintenance apparatus according to claim 1, further comprising a movement operation unit which moves the suction member in the second direction.

7. The ink jet head maintenance apparatus according to claim 1, wherein a width of the other opening in a third direction orthogonal to the second direction in the opening surface is wider than a width in the third direction of an ink discharge surface in an ink jet head determined in advance as a target of suction of ink.

8. An ink jet recording apparatus comprising:

an ink jet head maintenance apparatus according to claim 1, the suction operation unit, and an ink jet head provided with a nozzle which discharges ink, wherein the maintenance apparatus is positioned to be able to suction ink on an ink discharge surface by moving relatively in the second direction with relation to the ink jet head from a predetermined standby position and by moving in the first direction from a predetermined initial state to position the opening surface to face the ink discharge surface in which a nozzle opening of the ink jet head is provided.

9. The ink jet recording apparatus according to claim 8, wherein the second direction is a direction parallel to the ink discharge surface.

10. The ink jet recording apparatus according to claim 9, wherein the second direction is an arrangement width direction along a long side of a nozzle arrangement range in the ink discharge surface.

11. The ink jet recording apparatus according to claim 8, wherein after moving in the first direction of the opening surface, the suction member moves relatively in the second direction in a state biased in a direction of the ink discharge surface.

12. The ink jet recording apparatus according to claim 8, wherein the ink discharge surface is formed in a concave shape in which one portion including the nozzle opening is depressed with relation to the other surrounding portions.

13. The ink jet recording apparatus according to claim 8, further comprising a stage which fixes and holds the ink jet head, wherein the suction member comes into contact with the stage by moving relatively with relation to the ink jet head in the second direction from a predetermined standby position and the opening surface moves in the first direction in response to external force applied to a contacting portion.

14. The ink jet recording apparatus according to claim 13, wherein, in a state in which the suction member faces the ink discharge surface, the ink jet head is fixed and held by the stage in a position where the suction member comes into contact with the stage and the suction member does not come into contact with the ink jet head itself.

15. An ink jet head maintenance apparatus comprising:

a suction member which includes a suction hole to suction ink and in which air in the suction hole is suctioned from one opening of the suction hole by the suction operation unit, wherein, the suction member includes an elastic member, when the maintenance apparatus is attached to an ink jet recording apparatus provided with a head unit including an ink jet head which is to be a target of suction of ink, the suction member is moved relatively with relation to the ink jet head in a predetermined second direction intersecting with a normal direction of an opening surface which is in the predetermined initial state, wherein the opening surface is provided with the other opening of the suction hole, and in response to external strength applied to the opening surface, each position of the opening surface deforms to be able to move in a first direction which intersects with the second direction and which includes the normal direction;

a supporting stage operably connected to the suction member to support the suction member; and a plurality of leg portions extending between the supporting stage and the suction member, each leg portion including a spring member that expands and contracts in response to the external force in the first direction.

16. The ink jet head maintenance apparatus according to claim 15, wherein, the opening surface is provided in a position which comes into contact with the head unit when the maintenance apparatus is attached to the ink jet recording apparatus and when the suction member is moved relatively with relation to the ink jet head in the second direction from a predetermined standby position, and the suction member is able to move in the first direction up to a position where the opening surface does not come into contact with the head unit.

17. The ink jet head maintenance apparatus according to claim 16, wherein, the normal direction of the opening surface is provided tilted with relation to a normal direction of an ink discharge surface in which a nozzle opening of the ink jet head is provided.

18. The ink jet head maintenance apparatus according to claim 15, wherein the deforming includes deforming by bending along the second direction.

* * * * *